US007281969B2

(12) United States Patent
Naples et al.

(10) Patent No.: US 7,281,969 B2
(45) Date of Patent: Oct. 16, 2007

(54) TOOL SHARPENING AND COMPOUND HONING JIG

(76) Inventors: Donald Naples, P.O. Box 1326, Healdsburg, CA (US) 95448; Daniel Agee, P.O. Box 1326, Healdsburg, CA (US) 95448

( * ) Notice: Subject to any disclaimer, the term of this patent is extended or adjusted under 35 U.S.C. 154(b) by 54 days.

(21) Appl. No.: 11/127,908

(22) Filed: May 11, 2005

(65) Prior Publication Data

US 2006/0258271 A1 Nov. 16, 2006

(51) Int. Cl.
*B24B 19/00* (2006.01)

(52) U.S. Cl. ..... 451/371; 451/193; 451/234; 451/278; 451/349; 451/405

(58) Field of Classification Search ..... 451/193, 451/234, 235, 278, 293, 367, 369, 371, 391, 451/365, 349, 404, 405, 419; 83/174, 174.1
See application file for complete search history.

(56) References Cited

U.S. PATENT DOCUMENTS 3,011,366 A * 12/1961 Sandven et al. ..... 76/82
3,482,325 A 12/1969 Mitchell
4,270,315 A 6/1981 Reiling et al.
5,295,328 A 3/1994 Olbrich
5,545,081 A 8/1996 Haffely et al.
5,944,592 A 8/1999 Hall et al.
6,254,455 B1 7/2001 Irvine et al.
6,447,384 B1 9/2002 Jansson
6,676,495 B1 1/2004 Siemers et al.
7,112,124 B1 * 9/2006 Naples ..... 451/279
2006/0189263 A1 * 8/2006 Evans ..... 451/45
2006/0211348 A1 * 9/2006 Hyde et al. ..... 451/367

* cited by examiner

*Primary Examiner*—Eileen P. Morgan
(74) *Attorney, Agent, or Firm*—Thomas W. Cook

(57) ABSTRACT

A holder, guide, or jig for sharpening tools is disclosed, in which the jig holds and orients a tool to be sharpened to properly align the tool on or against abrasive wheels, discs, or sharpening stones, thereby creating a fine, square, beveled edge on the tool, at a predetermined and accurately reproducible angle.

9 Claims, 10 Drawing Sheets

20

TOOL SHARPENING AND COMPOUND HONING JIG

TECHNICAL FIELD OF THE INVENTION

The present invention relates to a holder for sharpening tools, used in conjunction with abrasive wheels, discs, or sharpening stones for sharpening and polishing the blades of such tools. More specifically, the present invention is a guide, rest, or jig (the invention generally termed herein the "Jig"), which holds and orients a tool to be sharpened (referenced to generally herein as the "Held Tool"), to properly align the Held Tool in relation to a moving or stationary sharpening wheel or disk. A sharpening surface, with the guidance of the Jig, moves under and against the cutting edge of the Held Tool aligned in the Jig, thereby creating a fine (and near perfectly square), beveled edge, at a predetermined and accurately reproducible angle. When a series of sharpening disks is provided with a cutting abrasive, the Jig may be used to progressively lap the beveled edge of the Held Tool to remove even microscopic imperfections. By removing the Held Tool from the Jig after sharpening, other edges of the tool may be dressed, or other faces of the tool polished, thereby producing an optimal cutting edge in the Held Tool, and an attractive appearance. When used with a standard sharping wheel, the jig of the present invention may also be used to produce a hollow-ground edge in tools which benefit from such hollow grinding.

BACKGROUND ART OF THE INVENTION

Sharpening is a common task for wood workers. Artisans the world over are constantly seeking apparatus and methods to produce a sharp edge on their tools, as only with a sharp tool can fine woodworking be achieved. For instance, a joint between two pieces of wood can only be effected if the wood is accurately formed, and such accuracy requires sharp tools. Chisels, plane blades, carving tools, axes, drawknifes, and other tools all must be prepared for use by grinding and polishing two intersecting surfaces to create a keen cutting edge or arris. However, used tools dull with use, so periodic sharpening is necessary. Many tool sharpening devices and techniques have been developed, but tool sharpening remains difficult for many tool users, primarily because sharpeners applied to the cutting edge of tools are not easily positioned accurately to produce the desired edge, and not consistently positioned so that the same angle and overall orientation is achieved from one re-sharpening to the next.

In some tools, this variation from one sharpening to the next is acceptable, or perhaps unavoidable. For instance, in pruners, the cutting edge of the pruner is generally short and curved, and the green wood through which the cutting edge will be drawn is soft. As a result, a few moments dressing a pruner may be sufficient to create a cutting edge of sufficient sharpness which will last an entire season. However, when working with dry and seasoned hardwoods, frequent sharpening of chisels and other cutters is necessary. Thus, cabinet makers and other wood workers often find their tools require dressing many times in a week. However, substantial practice, skill and time is required to utilize many sharpening devices and techniques, and wide-spread unfamiliarity with well-sharpened tools make it difficult for many tool users to accurately judge the quality of sharpening results. As a result, a simple apparatus and method to accurately position the edge of a Held Tool against a sharpener allows wood workers to create an edge of the proper shape. Such apparatus or method also orients a tool in relation to the sharpener to allow frequent sharpening without unnecessary loss of tool metal.

All relevant sharpening techniques involve abrading a Held Tool surface with abrasive materials, such as natural or man-made stones, or with abrasive particles deposited on another substrate. Among existing products intended for sharpening woodworking hand-tools are high-seed, "dry" grinding wheels that generally do not use lubrication, and low-speed "wet" wheels that use lubrication, typically water, on the wheel surface. Some of these products utilize relatively large diameter vertical wet or dry grinding or honing wheels, where the wheel edge is the principal working surface. Others utilize horizontal wheels where one face of the wheel is the principal working surface. A variety of abrasive "stones," usually having flat surfaces, are also available for manual sharpening.

A major difficulty with use of all abrasive wheels and manual stones, however, is maintaining proper orientation of the Held Tool, the tool which must be sharpened, in relation to the wheel or stone, the tool intended to act against the Held Tool so as to remove metal from the Held Tool in a desired manner. As noted above, proper orientation, consistently applied with each sharpening, optimally dresses an edge without unnecessary loss of metal from the Held Tool, and with minimal time and effort from the artisan who must restore the desired shape and sharpness. The challenge is to establish an optimal geometry between the Held Tool and the stone, and consistently reproduce that optimal geometry with each re-sharpening. Only by maintaining that same (optimal) geometry with each re-sharpening can a wood worker reproduce the correct sharpening angle and distance, and thereby merely dress the edge of the Held Tool without removing excessive metal, while requiring minimal time. Only by maintaining geometry with each re-sharpening can a wood worker insure a proper shape, that is, the shape which is optimal for cutting the desired shape for the task at hand.

Apparatus and methods for sharpening the edge of a tool are common, and various guides have been employed in an attempt to achieve easier and more accurate sharpening. Such guides may be as simple as a simple bar, suspended in a fixed or semi-fixed position over the grinding wheel or disk, against which the user may rest the Held Tool as it is lowered on to the moving wheel or disk. However, in the effort to create guides which more accurately hold the Held Tool, such guides are often more elaborate. Elaboration of guides may include simply adding a clamp to existing simple guide bars, or creating a special purpose jig which both clamps the Held Tool in place, and rolls along the cutting wheel or disk. In one such common jig, for instance, two halves of the jig are positioned along a slide mechanism which allows the two halves to move toward or away from one another. The two halves of such common jig are formed with edges which may close on a Held Tool, and thereby clamp it in position in the common jig, as the halves of the common jig close toward one another. Such a common jig is generally provided with a screw closure mechanism, by which the user may move the halves of the jig together by turning such closure mechanism, thereby clamping a Held Tool within the jig. Such a jig is generally also provided with a wheel, by which the jig, with Held Tool clamped in position, may be rolled against the grinding wheel or disk, to thereby maintain the Held Tool at the proper distance and angular orientation from the grinder.

However, existing guide bars and jigs are not set up for, or adaptable to, accurately maintaining the proper relationship between the grinding surface and the Held Tool. For instance, with a simple guide bar, merely resting the Held Tool against the bar, while moving the end of the Held Tool so that its edge is near or against the grinding surface, does not insure the edge of the Held Tool always bears against the grinding surface at the same angle. And common sharpening jigs do not improve accuracy in angular placement, but may even exacerbate this problem as the wheel upon which the jig depends for proper distance above the grinding surface allows the user to rotate the Held Tool around the axis of the wheel. Such rotation allows easy movement in angular position of the common jig, and the Held Tool in relation to the grinding surface with the common jig.

Moreover, jigs of common design depend for their operation on a narrow wheel. Such a narrow wheel can set the distance of the jig as a whole from the grinding surface, but still allow the common jig to rock from side to side, laterally. Such lateral movement of the common jig allows the Held Tool to rotate along its axis as it bears against the grinding surface, thereby grinding one side of the Held Tool more than the other side. Such insecure positioning of the Held Tool is precisely the opposite of the desirable firm positioning necessary to an accurate grinding.

Finally, jigs which have positioning wheels, even as they provide guidance for the Held Tool near its point of attachment to the jig, cannot provide guidance of the Held Tool close to its end, near the edge to be sharpened, because the wheel of such a jig must be kept substantially between the jig and the grinding surface. Truly accurate sharpening requires rigid control of the entire Held Tool. Such rigid control in turn requires the Held Tool be held rigidly, at two places along its length, or at least rigidly held at the distal end of the Held Tool, where the sharpening takes place. Any other arrangement is unlikely to be better than a simple guide bar, as the Held Tool in a common wheeled jig may rotate fully as much as (if not more than) the same Held Tool resting on a simple guide bar.

No apparatus or method for sharpening a Held Tool in the related art addresses the shortcomings encountered when working with guide bars and presently existing common sharpening jigs. In attempting to achieve accurate and reproducible sharpening results, and a sharpening regime in which the user sharpens less often and waists less of ones tool and time, others have created various sharpening apparatus, and sharpening guides to be used therewith or separately. Such apparatus and methods within the related art include:

U.S. Pat. No. 3,482,325 to Mitchell, which discloses a gauge for positioning drill bits for dressing on a grinding wheel.

U.S. Pat. No. 4,270,315 to Reiling et al., which discloses a fixture for holding a twist drill to be regound.

U.S. Pat. No. 5,295,328 to Olbrich, which discloses an apparatus for sharpening, grinding and polishing of dental, periodontal and/or surgical instruments.

U.S. Pat. No. 5,545,081 to Haffely et al., which discloses an apparatus for holding a tool having a cutting edge in a predetermined abrading orientation with respect to a tool abrading apparatus.

U.S. Pat. No. 5,944,592 to Hall et al., which discloses a sharpener apparatus comprising a linear bearing assembly mounted on a base, and a support block carried by the bearing assembly for reciprocating movement along a rectilinear path relative to the base.

U.S. Pat. No. 6,254,455 B1 to Irvine et al., which discloses a jig for use in sharpening a cutting implement for use in wood turning.

U.S. Pat. No. 6,447,384 B1 to Jansson, which discloses jig for grinding sharp-edged tools.

U.S. Pat. No. 6,676,495 B1 to Siemers et al., which discloses a powered sharpening system, and a tool rest used in conjunction therewith.

The inventions disclosed in these patents appear to fulfill their respective objectives. However, these prior patents do not describe or suggest an apparatus or method for sharpening a Held Tool in which a guide or jig accurately maintains the angular relationship between the grinding surface and the Held Tool, such that the correct bevel angle is created when sharpening the Held Tool. Such correct bevel must be that bevel appropriate for the cutting task at hand, and the same bevel sharpening after sharpening. No patent or jig of which the inventor is aware describes or suggests a jig which uses a roller to maintain an accurate distance between a Held Tool and a grinding surface, rather than a wheel. Such a roller prevents lateral, side to side, movement of the jig, thereby preventing a rolling of the Held Tool along its axis, with consequent uneven grinding of the Held Tool side to side. No patent or jig of which the inventor is aware provides support for the main body of the jig, and the main body of the Held Tool within the jig, and at the same time provides support for the Held Tool near its distal end, thereby insuring the Held Tool does not rotate in relation to the grinding surface, thereby changing the angle of the bevel at the edge of the Held Tool. Finally, no invention or jig of which the inventor is aware accomplishes all these functions in a simple, easy to use jig, in which the user may easily set the desired angle of the bevel to be created or maintained on a Held Tool consistently one sharpening to the next.

The present invention overcomes the drawbacks of prior inventions. A jig, with roller, is used for its small size, and ease of use with all kinds of sharpening systems, including both vertical sharpening wheels and horizontal sharpening disks or stones. The roller of the jig is formed to be wide enough to contact a large section of the cutting surface, thereby providing lateral stability so that the jig and Held Tool do not roll along the axis of the Held Tool. As a result, an accurately flat bevel is ground, with square profile, as the Held Tool does not roll out of square alignment with the cutting surface. The jig of the present invention has a clamp for holding the end of the Held Tool near its distal end during sharpening. As the clamp resides on one end of the Jig, which end is nearest the grinding surface during sharpening, the angle at which the tool is held against the grinding surface is kept constant, as the distal end of the Held Too is held securely in place, thereby preventing grinding imperfections due to flexure or vibration in the distal end of the Held Tool.

DISCLOSURE OF INVENTION

Summary of the Invention

In its simplest form, this invention is a honing guide, or "Jig," essentially a guide, with roller near one end (the "Roller End" of the Jig) and clamp near the other end (the "Clamp End" of the Jig), for positioning tools to be sharpened (the "Held Tool") in relation to a grinding stone, grinding wheel, or grinding or lapping disk (collectively, the "Disk"), so that such tools may be held securely, and therefore sharpened accurately. To use the Jig, the Held Tool is positioned in the Jig to allow a desired amount of metal to be removed from its edged end (the sharp end, or "distal end" of the Held Tool) once the Jig with Held Tool is placed on a Disk. Once so positioned, the clamp or clamps of the Jig are actuated to firmly grip the Held Tool, the Jig with Held Tool being thereby firmly secured within the Jig. Once the Held Tool and the Jig move together as one piece, with the desired amount of the Held Tool distal end protruding from the Jig, the Jig with Held Tool is then moved to the Disk. With the roller of the Jig positioned first on the Disk, the Clamp End of the Jig is then allowed to move toward the Disk as the Disk turns, thereby bringing the distal end of the Held Tool against the moving Disk. As a result of such use, a bevel is created, or maintained, in the distal end of the Held Tool, with a minimum of effort and minimal loss of material from the Held Tool.

While the invention in its simplest form as noted above produces the intended result, a number of features of the present invention provide assurance of accuracy in any single sharpening operation, and consistency from one sharpening operation to the next.

Most preferred embodiments of the present invention comprises two substantially parallel and flat side pieces (the Jig "Sides"), connected by at least one rigid bar (the Jig "Bar") extending between the Sides, and joining them to produce a rigid body. The Bar and Sides are preferably composed of metal, preferably machined from steel or aluminum, however other materials are possible, and the entire body composed of Sides and Bar may be formed in a unitary fashion from lighter materials such as hard injection molded plastic. The Bar may be positioned on the top of the Jig when the Jig is viewed in operation (that is, when the Jig is in position on the upper side of a Disk, and gripping a Held Tool). In such position, the Bar is fastened to or near the upper edges of the Sides. Alternatively, the Bar may be positioned on the bottom of the Jig when similarly viewed in operation, and the Bar therefore fastened to or near the lower edges of the Sides. In most preferred embodiments, the Bar will be positioned on the top of the Jig, as such positioning keeps the Bar farther from a Disk when in operation, while still allowing the insertion of a Held Tool. The Bar may be of almost any length, however the optimal length is just long enough to position the Sides of the Jig wide enough to accept the width of most Held Tool, as the wider the Jig is, the more likely some portion of it may not rest on the Disk used. Also, the width of the Jig allows its use on the edge of a sharpening wheel, and the Jig should be wider than most such wheels, however excessive width in the Jig may result in some uneven results if a user applies uneven pressure of the Jig against the wheel. Therefore, preferred embodiments of the invention generally range from three inches wide to about four and a half inches wide, for hand-operated Held Tool. Such widths allow the Jig to accept such tools at widths up to about three inches wide, thereby allowing a user to sharpen planing blades as well as broad chisels.

Between the Sides, which are now held rigidly parallel to one another by the Bar, a roller is positioned between complementary ends of the Sides, near the Roller End of the Jig. The roller, or a pin or other feature extending from the ends of the roller, extends to and through holes formed in Sides at the Roller End of the Jig. In the alternative, screws or pins or other fastening means may be affixed through holes in the Sides at the Roller End of the Jig, or the Sides may be formed with extensions which may fit into complimentary wells formed in the roller to hold the roller between the Sides. All such alternative means for maintaining the roller in its position between the Sides (the "Roller Pins") establish an axis of rotation for the roller within the Sides of the Jig, and the Roller Pins must allow free movement of the roller around its axis when so positioned within the Jig. As preferred embodiments of the present invention are generally wider than guides common in the art, the roller of the Jig of the present invention increases the surface area over which the Jig runs on a Disk. As a result, wear, and particularly uneven wear, on the abrading area of the Disk is reduced.

Between the Sides, a tool rest (the "Rest") is also positioned between complimentary ends of the Sides, generally near the end of the Jig most distant from the roller (the "Rest End" of the Jig). The Rest is also held in position between the Sides of the Jig with pins or other features extending from the ends of the Rest, to and through holes formed in Sides at the Rest End of the Jig, or with screws or pins or other fastening means affixed through holes in the Sides at the Rest End of the Jig, or with extensions formed from the Sides which may fit into complimentary wells formed in the Rest to hold the Rest between the Sides of the Jig. All such alternative means for maintaining the Rest in its position between the Sides (the "Rest Pins"), as with the Roller Pins, establish an axis of rotation for the rest within the Sides of the Jig, and must allow free movement of the Rest around its axis when the Rest is positioned within the Jig.

The Rest is further provided with additional positioners, generally in the form of additional screws, threaded pins, or dowel pins extending from the ends of the Rest, or insertable into wells in the Rest from or through the Sides of the Jig. All such additional positioners (the "Tightening Pins") are formed to lie generally parallel to the Rest Pins, but they are displaced from the Rest Pins along the ends of the Rest. Accordingly, as the Rest rotates around its axis established by the Rest Pins, the Tightening Pins travel in an arc around the axis of rotation of the Rest. The Tightening Pins also extends to and through the Sides at the Rest End of the Jig. To accommodate the Tightening Pins, curved slots, formed in an arc, rather than simple holes, are formed in the Sides of the Jig. When the Jig is assembled, the Tightening Pins extend through the curved slots in the Sides. However, the arc established by the Tightening Pins as they move about the axis of the Rest matches the arc of the curved slots. As a result of this construction, the Rest may rotate freely about its axis when it is in position between the Sides of the Jig, with the Tightening Pins in place and extending through the Sides. The Tightening Pins may travel freely in the curved slots up to the limits established by the ends of the curved slots, at which point the Tightening Pins bear against the slot ends.

The Tightening Pins are generally threaded, and generally originate from the ends of the Rest, and extend away from the Rest and through the Sides of the Jig. With such arrangement, a nut or other fastener easy to turn by hand, may formed to engage the Tightening Pins. As a result, a user may turn the nut on the Tightening Pins so as to cause it to move toward and against the Sides of the Jig, at which point the nut binds against the Sides of the Jig, and the Tightening Pins (and the Rest to which the Tightening Pins are attached) are temporarily fixed position in relation to the Sides of the Jig. In the alternative, Tightening Pins which originate from the ends of the Rest may have an attached or attachable lever, with eccentric, or other means which allows the Tightening Pins to be fixed, generally by friction, in relation to the Sides of the Jig. In the alternative, the Tightening Pins may be threaded, but be separable from the Rest and the Jig. In such configuration, the Tightening Pins are essentially screws or bolts formed to be turned by hand, which screws or bolts may be inserted through the curved slots in the Sides of the Jig, and into the wells in the Rest formed to receive the Tightening Pins. Whether the Tightening Pins originate from the Rest or are inserted into the Rest from the exterior of the Jig, the Tightening Pins are formed as a means to temporarily fix the Rest in one rotational position in relation to the Sides. Any Held Tool bearing against the Rest will correspondingly be fixed temporarily in one rotational position in relation to the Sides.

In most preferred embodiments of the present invention, a spring-loaded button or plunger (the "Plunger") is also fitted in or to the Rest, or extensions of the Rest at its ends, and dimples or holes formed in the Sides of the Jig. When used in the invention, the springs of the Plunger thrust the Plunger, or an end of Plunger toward the Sides of the Jig and, if the dimples or holes in the Sides are aligned with the Plunger, into the dimples or holes. This arrangement of Plunger and corresponding holes allows the user to consistently set the rotational direction of the Rest within the Jig, and thereby consistently angle a Held Tool against a Disk during sharpening. This arrangement also allows a user to quickly place a Held Tool in the Jig, and correctly position it for sharpening by loosening the Tightening Pins, and flipping the Rest to a new position within the Jig. The springs behind the Plunger are chosen to provide the user with positive guidance on the correct (or at least consistent) angle for sharpening individual Held Tools, while allowing the user to easily disengage the Plunger from the holes in the Sides by turning the Rest in the Jig. In some preferred embodiments, set screws are also supplied to allow the user to adjust the tension asserted by the springs behind the Plunger. The set screws, accessible from within the Rest, thereby allow a user to adjust the force with which the Plunger are pushed toward or into the dimples or holes in the Sides of the Jig. One preferred embodiment of the invention provides five of these "spring-loaded" positions, which position and hold a Held Tool at angles chosen by a user anywhere from 20 degrees to 40 degrees from Held Tool to Disk surface (i.e., 20 to 40 degree bevels on the Held Tool), with and accuracy of a single degree of angle. In the alternative, Plunger may be fitted in or to the Sides of the Jig, and corresponding dimples formed in the ends of the Rest, to achieve a similar direction setting facility.

To the Rest, a supplementary bar (the "Clamp") is appended, generally by means of screws or bolts which extend through the Rest near its ends, and attach to the Clamp near its corresponding ends. With such screws or bolts, a user may turn nuts or dials which engage the screws or bolts, to thereby move the Clamp toward and against the Rest. Springs may also be supplied between the Clamp and the Rest to put tension on the screws or bolts as the springs urge the Clamp away from the Rest. By such action, the user may tighten an object, such as a Held Tool, between the Clamp and the Rest. If used, the springs hold the Clamp and the Rest away from one another to allow easy insertion of a Held Tool between the Clamp and the Rest. The Clamp and Rest may be designed to open away from one another almost any reasonable distance, however most Held Tool are relatively thin, needing only so much thickness as to result in a rigid body which resist bending, flexing and vibration when under pressure. Therefore, optimally the Rest and Clamp will be designed to accept tools at thicknesses from about 0.07 to over half an inch thick. This allows accurate sharpening of Held Tool up to about one half inch over the full range of bevels the user wishes for ones tools (i.e., generally 20 to 40 degrees). Once placed between the Rest and the Clamp, the nuts engaging the screws or bolts may thereafter be actuated to pull the Clamp and Rest toward one another. By such action, the user may temporarily but firmly position a Held Tool between the Clamp and the Rest. If the Held Tool is correctly positioned, it may also be firmly positioned within, or engaged with, a groove or grooves formed in the Rest or the Clamp, which groove or grooves may be formed to increase the stability of a Held Tool within the Jig, between the Rest and the Clamp, during sharpening.

The Clamp is preferably appended to the lower side of the Rest in this fashion, however the Clamp may in some embodiments also be appended to the upper side of the Rest. When the Clamp is appended to the lower side of the Rest, it may be appreciated that the means for appending, whether screw or bolt, must not extend through the Clamp, so as to extend toward the sharpening Disk when sharpening is underway. Any such extension of the appending means is likely to put such means on the surface of the Disk during such sharpening, with the result that the screw or bolt used to append the Clamp is shortened by the grinding action of the Disk. Accordingly, when the Clamp is appended to the lower side of the Rest, the means for appending the Clamp to the Rest ends at, and is firmly affixed to, the ends of the Clamp. By actuating the screws or bolts or other means to append the Clamp to the Rest, such means moves through the ends of the Rest, allowing the Clamp to move in relation to the Rest.

Appending the Clamp to the lower side of the Rest is the preferred configuration for Clamp and Rest, as the Clamp may be thinner than the Rest against which it works. Consistent with the requirement that a Held Tool be securely positioned without bending the Clamp, the Clamp may be sized to be quite thin. The advantage to this is that a Held Tool may be positioned in the Jig with the tip of the Held Tool just protruding from between the Rest and Clamp. This positioning of the tip of the Held Tool allows short tools to be sharpened on a sharpening disk, when such tools could otherwise only be sharpened on a wheel, and such positioning also allows sharpening of short tools on either a disk or a wheel with the assistance of a guide, when such tools could otherwise only be sharpened freehand.

In some embodiments, however, the Clamp may be appended to the upper side of the Rest. In such position, it may be appreciated that the means for appending, whether screw or bolt, must not extend through the Rest, so as to extend toward the sharpening Disk when sharpening is underway. As with the situation in which the Clamp is below the Rest, any such extension of the appending means below the Rest when the Rest is lower than the Clamp is likely to put such means on the surface of the Disk during such sharpening. Accordingly, when the Clamp is appended to the upper side of the Rest, the means for appending the Clamp to the Rest ends at, and is firmly affixed to, the ends of the Rest. By actuating the nuts or dials which engage the screws or bolts (or other means used to append the Clamp to the Rest), the nuts or dials move away from or toward ends of the Clamp, thereby allowing the Clamp to move along the screws. As the nuts are tightened on the screws or bolts, the Clamp is urged toward the Rest.

Whether the Clamp is below or above the Rest, however, the arrangement of Clamp and Rest allows a Held Tool to be gripped from the top and bottom rather than from its sides as in most common sharpening guides. Holding a tool on the top and bottom allows the Held Tool to be held along its entire under and upper sides, thereby lending additional stability in positioning the Held Tool against a Disk, and at the same dampening the Held Tool from vibration. As the corners and angles of the Jig are each square, and as the Jig sits flat against a Disk, the Jig allows perfectly square registration on the edge of any Held Tool requiring square tool registration. A user does not vary that square registration even if the user moves the Jig out of square alignment with the motion of the Disk under the Held Tool. Moreover, because a Held Tool sits within the Jig bevel down, the flat "back" of the tool bears against the underside of the Rest in most preferred embodiments of the invention. This position inherently provides a better angle for accurately producing a squarely ground tip on the Held Tool, and at the same time allows a user to observe the "squareness" of the tip while sharpening takes place.

In operation, a user first selects one of the five positions (in one preferred embodiment of the present invention) depending on the desired angle for the Held Tool to be sharpened. It may be noted that the correct angle for any single Held Tool may be easily determined by visual inspection once the tool is placed in the Jig, as a user may sight along the underside of the Jig, from the Roller End of the Jig to the Rest End of the Jig. From such perspective, a user should easily observe the beveled face at the distal end of the Held Tool if the angle at which this particular Held Tool was sharpened before was greater than or less than the angle at which the Jig is presently set. Under such circumstances, the user may simply loosen the Tightening Pins, flip the Rest and Clamp assembly into a new position which matches (or most closely matches) the angle at which the Held Tool was formerly sharpened, and re-tighten the Tightening Pins so that the Rest and Clamp assembly is again firmly positioned within the Jig at the correct (or best) grinding angle. In one preferred embodiment of the present invention, the Jig allows the user to chose any one of five angular positional settings, depending on the desired sharpening angle. However, all Jigs constructed consistent with the present invention are within the scope of this patent, whatever the number of settings at which a Held Tool may be positioned.

Once an appropriate angle for sharpening a Held Tool has been chosen and set using the angular positional settings and the Tightening Pins, the user must then also generally reposition the Held Tool to extend its distal end closer to, or further from, the Rest and Clamp assembly. This is accomplished by loosening the nuts or dials which engage the screws or bolts used to append the Clamp to the Rest, thereby allowing the nuts or dials to move away from the ends of the Clamp, thereby further allowing the Clamp to similarly move along the screws away from the Rest, and so releasing the Held Tool from the Jig. Once released, the position of the Held Tool may be adjusted longitudinally by moving the Held Tool in one direction or another parallel to its length, thereby repositioning its distal end closer to, or further from, the Rest and Clamp assembly. It may be noted that the correct distance from the distal end of any single Held Tool may again be easily determined by visual inspection once the tool is placed in the Jig, as a user again may sight along the underside of the Jig, from the Roller End of the Jig to the Rest End of the Jig. From such perspective, a user should easily observe that the beveled face at the distal end of the Held Tool is parallel to, and in line with, the underside of the roller at the Roller End of the Jig, and the underside of the Clamp at the Rest End of the Jig. Once the Held Tool is in the correct position along its length, the nuts or dials, which engage the screws or bolts appending the Clamp to the Rest, are again tightened, until the Clamp and Rest again firmly grip the Held Tool. The distal end of the Held Tool is now at the correct distance from the Clamp and Rest and, from the previous operation, the correct bevel is set within the Jig. The Jig and Held Tool may now be set on a Disk for sharpening.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing apparatus and methods of the prior art, and in so doing provides the user with the highly desirable ability to (1) register planes and chisels from the back of Held Tools for better angle accuracy, (2) clamp Held Tools from their top and bottom rather than their sides, (3) use a square registration edge for easy square Held Tool registration, (4) use a long roller on the Jig, with increased surface area to reduce wear on an abrading stone or disk, and (5) allow short Held Tools to be sharpened on a sharpening disk, rather than on just water stones or other abrasive sharpening system.

OBJECTS OF THE INVENTION

A principal object of the present invention is to allow a Held Tool to be gripped from the top and bottom rather than from its sides as in most common sharpening guides, to stabilize the position of the Held Tool against a Disk, and dampening the Held Tool from vibration.

A further principal object of the present invention is to provide a Jig which allows perfectly square registration on the edge of any Held Tool requiring square tool registration, and a Jig which prevents movement of the Jig from the preferred square alignment with motion of the Disk under the Held Tool.

A further principal object of the present invention is to provide a Jig in which the Held Tool sits within the Jig bevel down, the flat "back" of the tool bearing against the underside of the Rest in most preferred embodiments of the invention, thereby allowing a better angle for accurately producing a squarely ground tip on the Held Tool, while at the same time allowing a user to observe the "squareness" of the tip during sharpening.

A further principal object of the present invention is to allow a user to select one of a number of positions by which to set the desired angle for the bevel at the distal end of the Held Tool to be sharpened.

A further principal object of the present invention is to allow a user to reposition a Held Tool to extend its distal end closer to, or further from, the Rest and Clamp assembly of the Jig.

A further principal object of the present invention is to allow a user to set both the angle at which a Held Tool is to be sharpened and the depth of sharpening by visual inspection once the tool is placed in the Jig, as a user may sight along the underside of the Jig, from the Roller End of the Jig to the Rest End of the Jig.

A further principal object of the present invention is to provide a Jig with a long roller on the Jig, with increased surface area to reduce wear on an abrading surface.

A further principal object of the present invention is to allow a user to sharpen short Held Tools on a sharpening disk, as well as on water stones or other abrasive sharpening system.

BRIEF DESCRIPTION OF DRAWINGS

The accompanying drawings, which are incorporated in and constitute a part of this specification, illustrate one preferred embodiment of the present invention, and such drawings, together with the description set forth herein, serve to explain the principles of the invention.

DETAILED DESCRIPTION OF A FIRST PREFERRED EMBODIMENT

First Preferred Embodiment

Figure 1:
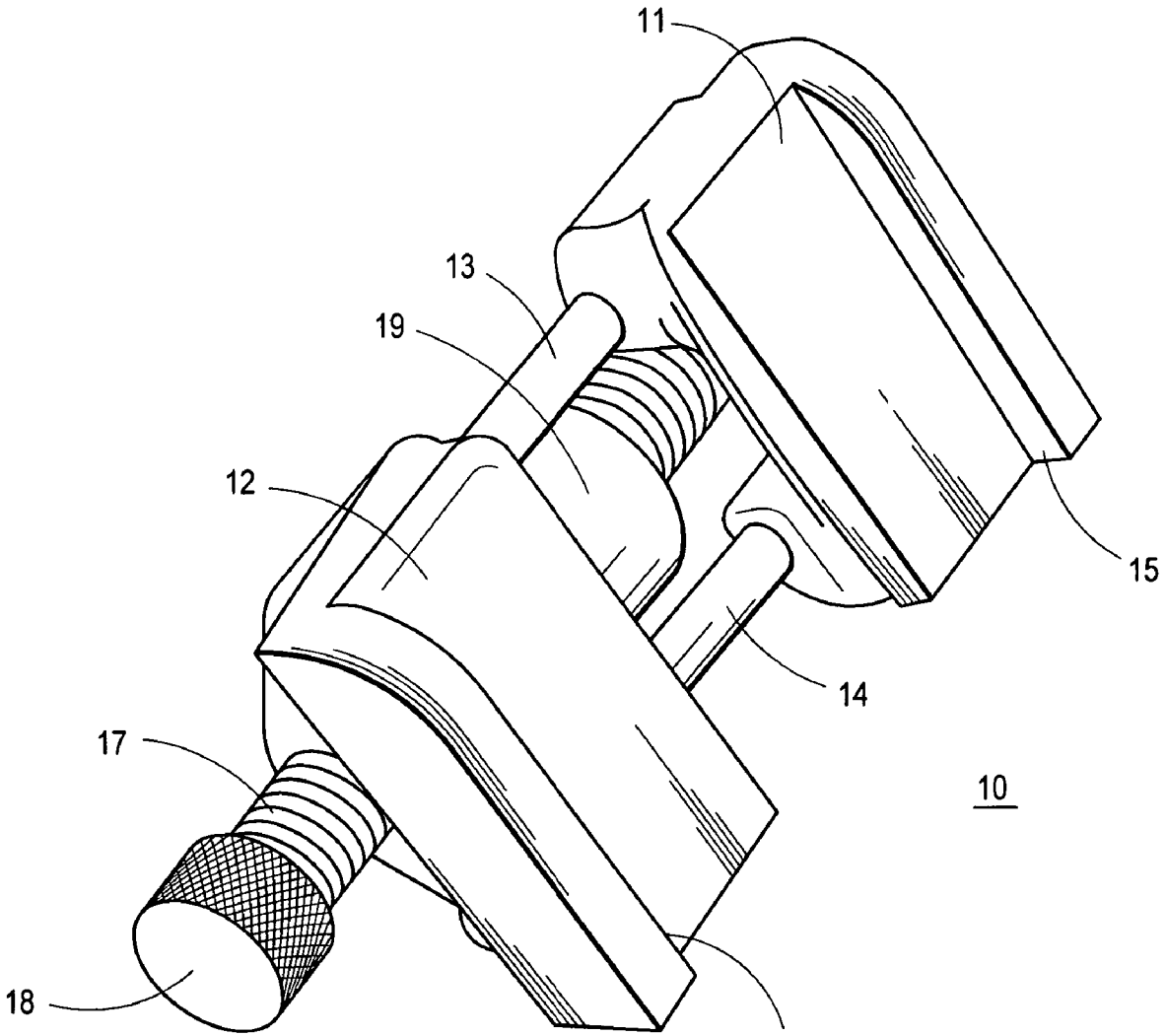
FIG. 1 is a perspective view of a sharpening guide in common use today.

Referring initially to FIG. 1, a sharpening guide or jig in common use is shown in perspective view. In FIG. 1, the jig 10 comprises a left side 11 and a right side 12, with guidebars 13 and 14 there between. Guidebars 13 and 14 allow left side 11 and right side 12 to slide toward or away from each other, but otherwise maintain the sides in position with respect to one another. Side 11 and side 12 each have lips 15 and 16 by which a tool (not shown) may be held, as side 11 and side 12 move toward one another, and thereby engage the edges of the tool to hold it firmly. Threaded bolt 17 is provided with threads which reverse at either end of threaded bolt 17, so that Sides 11 and 12 with which bolt 17 engages will move toward the center of bolt 17 from both of its ends if bolt 17 is turned one way, and away from the center of the bolt toward one of its ends if the bolt is turned the other way. Threaded bolt 17 engages matching interior threads in each of side 11 and side 12 to provide the force to pull side 11 and side 12 toward one another. Threaded bolt 17 is further provided with a thumb-screw head 18 which may be turned by hand, and a narrow roller 19 turns on threaded bolt 17, thereby allowing the jig 10 to roll across the surface of the sharpening surface of a sharpening wheel or disk.

Figure 2:
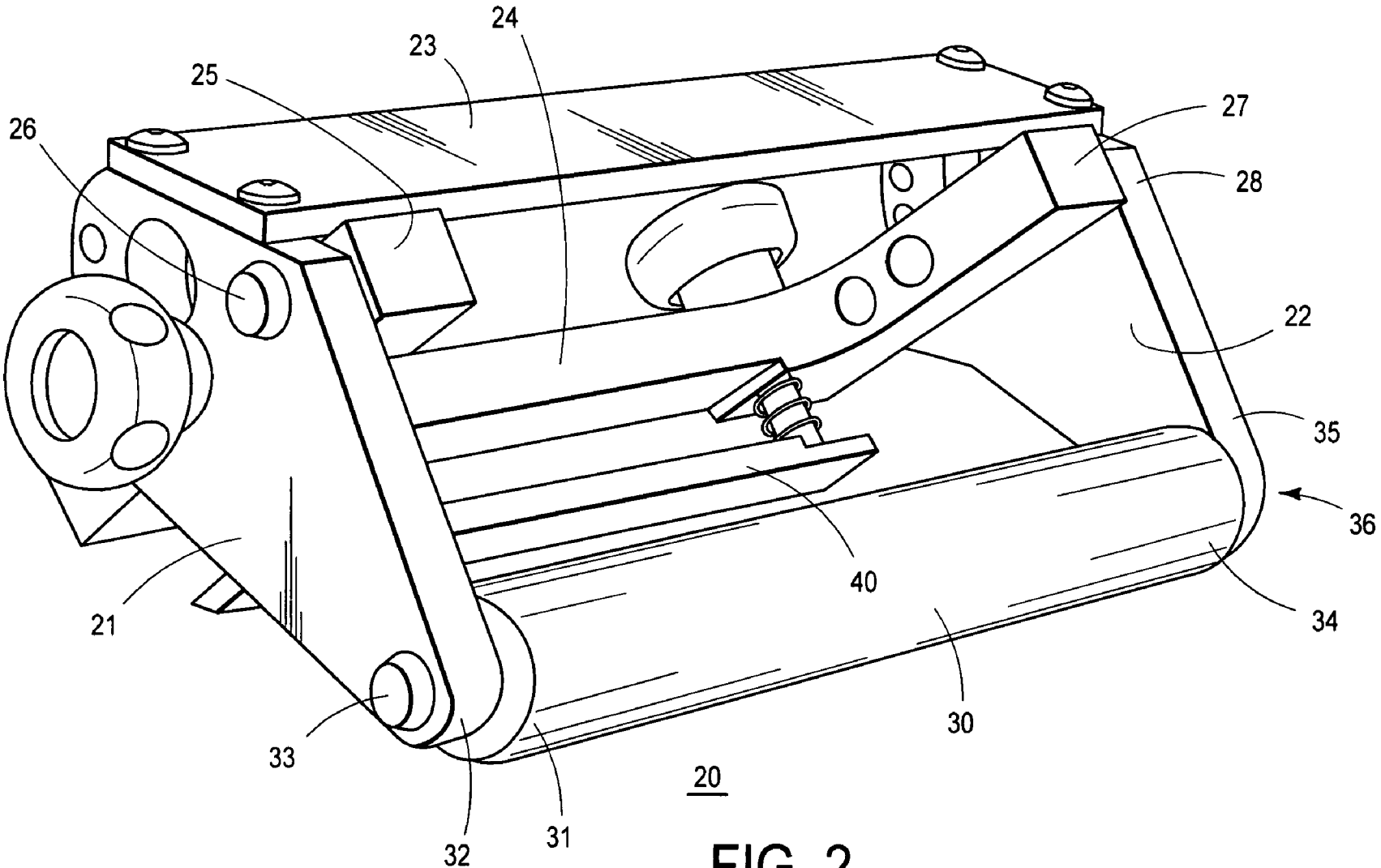
FIG. 2 is a perspective view drawing of one preferred embodiment of the Jig of the present invention, viewed from the left rear quarter of the Jig.

FIG. 2 shows a first embodiment of the present invention in perspective view, from the left rear quarter. In FIG. 2, the Jig of the present invention 20 has two substantially parallel and flat Jig Sides, comprising left Jig Side 21 and right Jig Side 22, between which extends rigid Jig Bar 23. Bar 23 is rigidly connected to left Side 21 and to right Side 22, thereby joining left Side 21 and right Side 22 to produce a rigid body for Jig 20. Bar 23, left Side 21, and right Side 22, are in this preferred embodiment composed of metal, in this case machined steel. FIG. 2 also shows Jig Rest 24, with its left end 25 rotationally attached to left Side 21 by Rest Pin 26, and Rest 24 right end 27 rotationally attached to right Side 22 by Rest Pin 28 (not shown). As Rest 24 is rotationally attached to Sides 21 and 22, Rest 24 may rotate about the axis established by Pins 26 and 28 within Sides 21 and 22 of Jig 20. As Sides 21 and Side 22 are fixed positionally in respect of each other by Bar 23, Rest 24 is consequently constrained within (or "trapped" within) Sides 21 and 22 when Jig 20 is assembled. However, Rest 24 may in assembled Jig 20 easily rotate around the axis established by Pins 26 and 28 within Jig 20. FIG. 2 also shows Jig Roller 30, with its left end 31 rotationally attached to left Roller End 32 of left Side 21 by Roller Pin 33, and Roller 30 right end 34 rotationally attached to right Roller End 35 of right Side 22 by right Roller Pin 36 (not shown). As Roller 30 is rotationally attached to Sides 21 and 22, Roller 30 may rotate about the axis established by Pins 33 and 36 within Sides 21 and 22 of Jig 20. Again, Sides 21 and Side 22 are fixed positionally in respect of each other by Bar 23, so Roller 30 is consequently constrained within Sides 21 and 22 when Jig 20 is assembled, but Roller 30 may rotate freely about the axis established by Pins 33 and 36 within Jig 20. FIG. 2 also shows Clamp 40 movably attached to Rest 24.

Figure 3:
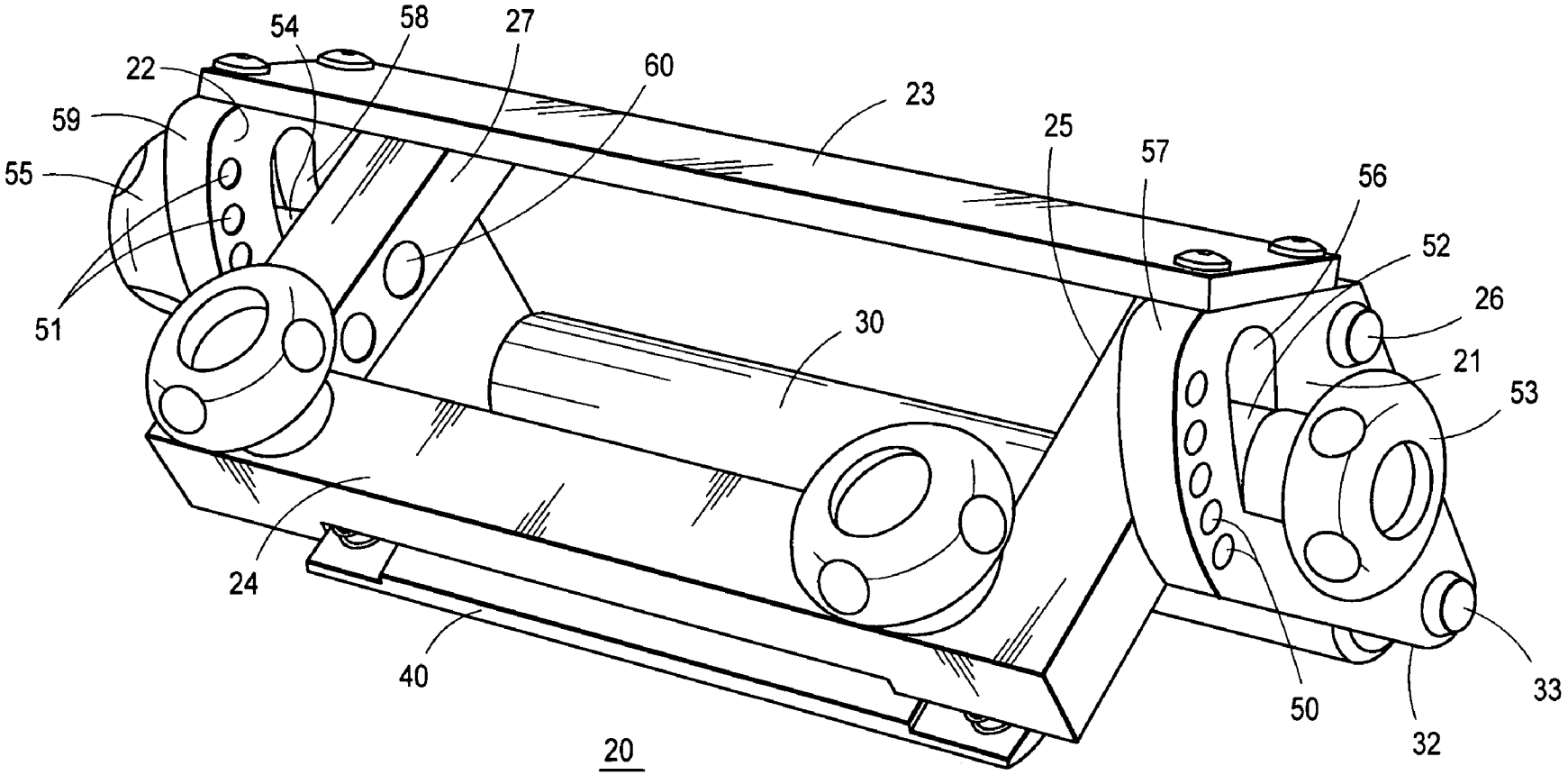
FIG. 3 is a perspective view drawing of the preferred embodiment of the Jig of the present invention shown in FIG. 2, viewed from the left front quarter of the Jig.

Referring now to FIG. 3, Jig 20 is shown in perspective view, viewed from the left front quarter, with Rest 24 and Roller 30 rotationally trapped within Sides 21 and 22 under Bar 23, and Clamp 40 movably attached to Rest 24. FIG. 3 also shows five holes 50 formed in left Side 21 of Jig 20. FIG. 3 also shows threaded left Tightening Pin 52 with attached finger-actionable left Tightening Pin nut 53, by which a user may turn left Tightening Pin 52, causing left Tightening Pin 52 to follow the motion of left nut 53, and so turn in the same direction. In FIG. 3, left Tightening Pin 52 extends through left curved slot 56 in the Rest End 57 of left Side 21, and into the left end 25 of Rest 24. When left Tightening Pin 52 is turned in the direction to "tighten" left Tightening Pin 52, it moves toward left Side 21 and Rest 24, and attached left nut 53 moves toward left Side 21, and eventually against it, at which point left nut 53 binds against left Side 21. When left nut 53 binds against left Side 21, Rest 24, which turns freely on its axis established by left and right Rest Pins 26 and 28, is temporarily immobilized within Jig 20.

A similar, mirror image, arrangement appears on the right Side 22 of Jig 20, where FIG. 3 also shows five holes 51 formed in right Side 22 of Jig 20. FIG. 3 also shows threaded right Tightening Pin 54 with attached finger-actionable right Tightening Pin nut 55, by which a user may turn right Tightening Pin 54, causing it to follow the motion of right nut 55, and so turn in the same direction. In FIG. 3, right Tightening Pin 54 extends through right curved slot 58 in the Rest End 59 of right Side 22, and into the right end 27 of Rest 24. When right Tightening Pin 54 is turned in the direction to "tighten" right Tightening Pin 54, it moves toward right Side 22 and Rest 24, and attached right nut 55 moves toward right Side 22, and eventually against it, at which point right nut 55 binds against right Side 22. When right nut 55 binds against right Side 22, Rest 24 is again temporarily immobilized within Jig 20.

When ready for use, the end of threaded left Tightening Pin 52, engaged with Rest 24, travels into a complementary threaded left well (not shown) in the left end 25 of the Rest 24, while the end of threaded right Tightening Pin 54, engaged with right end 27 of Rest 24, travels into a complementary right well 60 in the right end of Rest 24. Curved left slot 56 and curved right slot 58 are formed in arcs in left Side 21 and right Side 22 of Jig 20. Accordingly, as Rest 24 may rotate around its axis established by Rest Pins 26 and 28, Tightening Pins 52 and 54, which extend from Rest 24 when Jig 20 is ready for use, and through left Side 21 and right Side 22 respectively, may each travel in arcs around the axis of rotation of Rest 24 while they travel within the arcs of slots 56 and 58.

Figure 4:
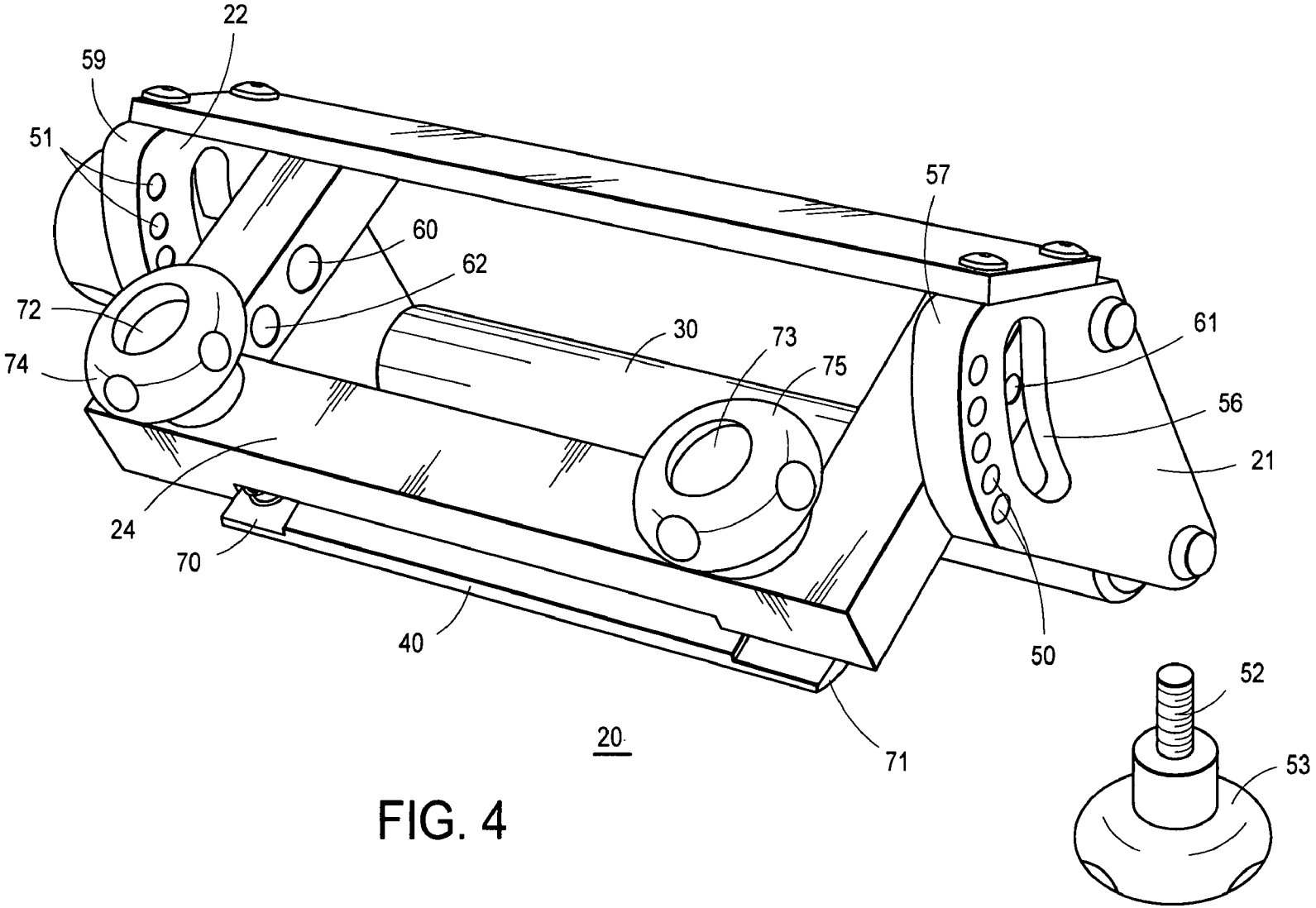
FIG. 4 is a perspective view drawing of the preferred embodiment of the Jig of the present invention shown in FIG. 2, viewed from the left front quarter of the Jig, in which one Tightening Pin is disengaged from the Jig.

Turning now to FIG. 4, the first preferred embodiment of the present invention is again shown in perspective view, viewed from the left front quarter, with Rest 24 and Roller 30 rotationally trapped within Sides 21 and 22 under Bar 23, and Clamp 40 movably attached to Rest 24. However, in FIG. 4, threaded left Tightening Pin 52 with attached finger-actionable left Tightening Pin nut 53, has been disengaged from complementary threaded left well 61 in the left end of the Rest 24. In such position, threaded left well 60 is visible through curved left slot 56. Also visible in FIG. 4 is the end of a spring-loaded, generally adjustable, right Plunger 62, fitted in Rest 24. When positioned in the right end of Rest 24, the end of right Plunger 62 facing out from the interior of Jig 20 may align with any of five holes 51 in Rest End 59 of right Side 22. As right Plunger 621 is spring-loaded, the outside facing end of right Plunger 62 will tend to move toward holes 51, and engage one of holes 51 when Plunger 62 is aligned with one such hole. Such engagement provides a positive "click" angle adjustment when orienting Rest 24 within Jig 20. A similar left Plunger (not shown) is positioned in the left end of Rest 24. The end of left Plunger also faces out from Jig 20, in such position in Rest 24 that the outside facing end of left Plunger may align with any of five holes 50 in Rest End 57 of left Side 21. Again, the result is engagement of the end of left Plunger with one of holes 50, and a positive "click" angle adjustment when orienting Rest 24 within Jig 20.

The positive "click" angle adjustment of Rest 24 within Jig 20 therefore allows a user to consistently set the rotational direction of Rest 24 within Jig 20, and thereby consistently angle Rest 24, and any Held Tool (not shown) secured against Rest 24, in Jig 20. This arrangement also allows a user to quickly place any Held Tool in Jig 20, and correctly position Rest 24 for sharpening at a new angle by loosening Tightening Pins 52 and 54, and flipping Rest 24 to a new position within Jig 20. The springs behind each Plunger are chosen to provide the user with positive guidance on the correct, consistent angle for sharpening individual Held Tools (not shown). Set screws (not shown) behind right and left Plungers may also allow the user to adjust the tension asserted by the springs behind right and left Plungers.

Also shown in FIG. 4 is Clamp 40, appended at its right Clamp End 70 to the right end of Rest 24 by threaded right Clamp bolt 72, and appended at its threaded left Clamp End 71 to the left end of Rest 24 by left Clamp bolt 73. The appending of Clamp 40 to Rest 24 allows movement of the Clamp toward and away from Rest 24, as right Clamp bolt 72 and left Clamp bolt 73, each firmly affixed respectively to the right Clamp End 70 and left Clamp End 71 of Clamp 40, extend through and may move easily through, complementary holes (not shown) in the ends of Rest 24. As the ends of the Clamp bolts extend from the surface of Rest 24 when in position for tightening, right and left Clamp nuts 74 and 75, with matching threads may be fitted onto Clamp bolts 72 and 73 respectively, and screwed on Clamp bolts 72 and 73 until right Clamp nut 74 and left Clamp nut 75 contact Rest 24. At such contact, further turning of Clamp nuts 74 and 75 pulls Clamp bolts 72 and 73 through the corresponding holes in the right and left ends of Rest 24, thereby pulling right and left Clamp Ends (and so Clamp 40 as a whole) toward Rest 24. Springs (not shown) may also be supplied between Clamp Ends 70 and 71 on the one hand, and Rest 24 on the other hand, to put tension on Clamp bolts 72 and 73, as the springs urge Clamp 40 away from Rest 24. By correctly working right and left Clamp nuts 74 and 75, a user may tighten an object, such as a Held Tool (not shown), between Clamp 40 and Rest 24.

Figure 5:
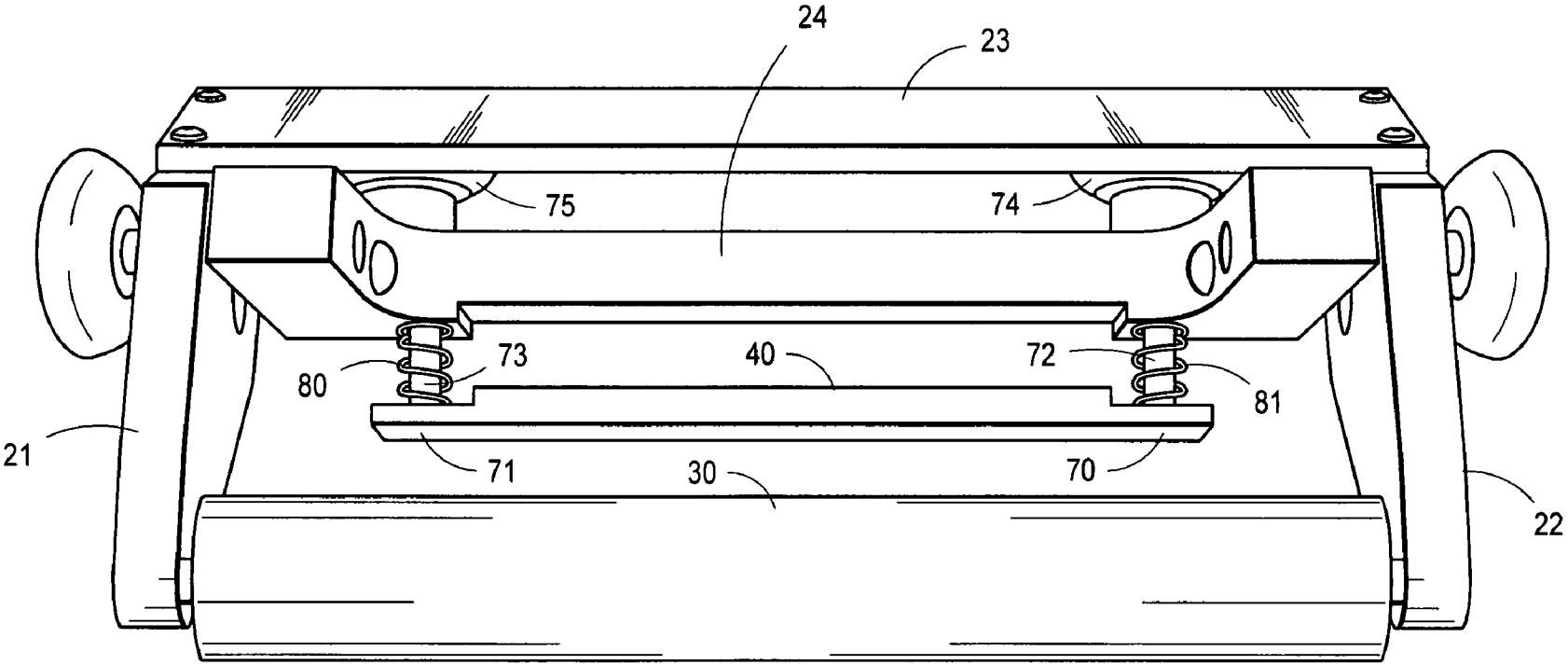
FIG. 5 is a perspective view drawing of the preferred embodiment of the Jig of the present invention shown in FIG. 2, viewed from the rear of the Jig.

Turning now to FIG. 5, the first preferred embodiment of the present invention is again shown in perspective view, viewed from the rear, with Rest 24 and Roller 30 rotationally trapped within Sides 21 and 22 under Bar 23, and Clamp 40 movably attached to Rest 24. In addition, left Clamp bolt spring 80 is shown wound on left Clamp bolt 73 between left Clamp End 71 and Rest 24, while right Clamp bolt spring 81 is shown wound on right Clamp bolt 72 between right Clamp End 70 and Rest 24. Each Clamp bolt spring puts tension on Clamp bolts 72 and 73, as the springs urge Clamp 40 away from Rest 24. By correctly working right and left Clamp nuts 74 and 75, a user may tighten an object, such as a Held Tool (not shown), between Clamp 40 and Rest 24.

Figure 6:
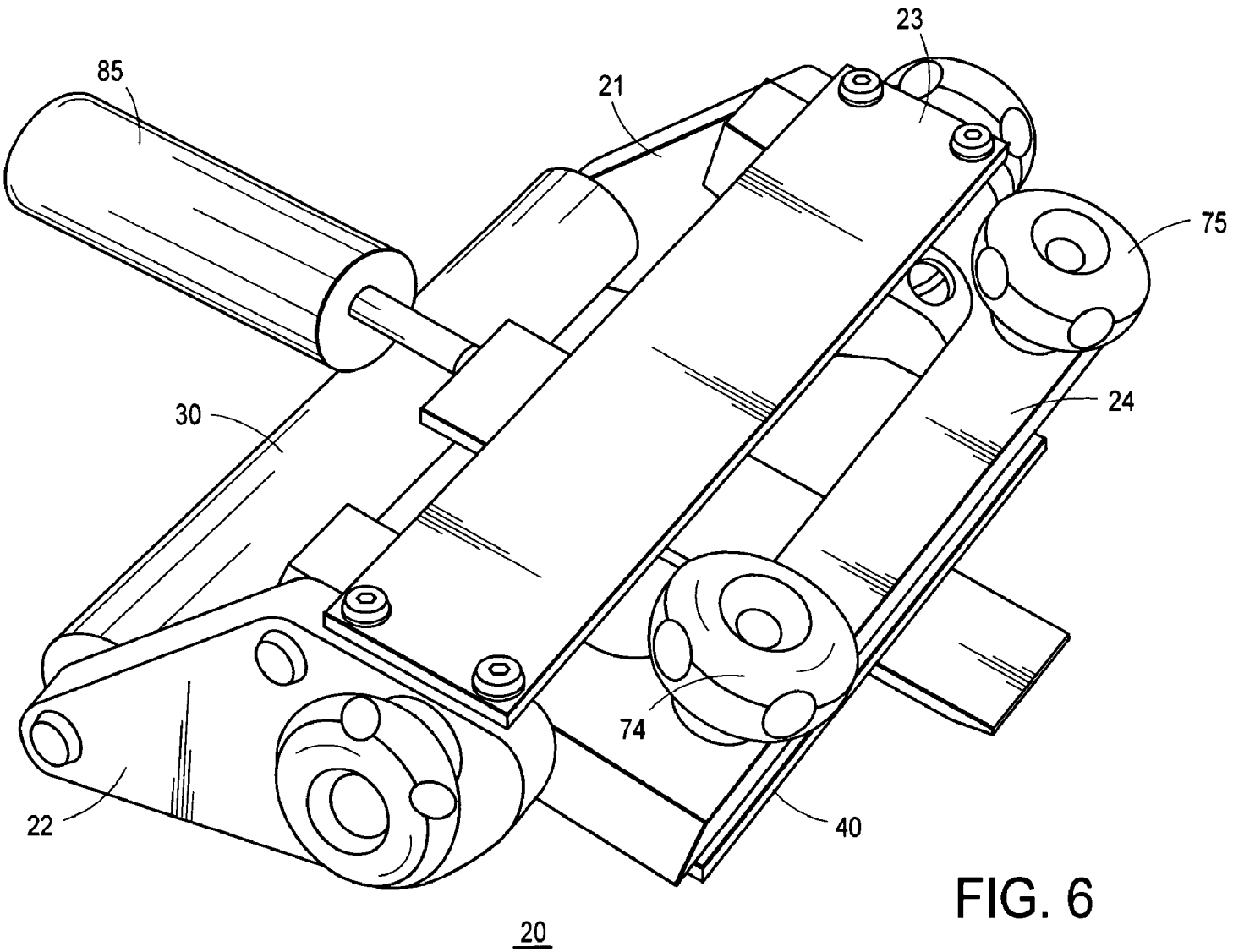
FIG. 6 is a perspective view drawing of the preferred embodiment of the Jig of the present invention shown in FIG. 2, viewed from the right front quarter of the Jig, in which a Held Tool (chisel) is secured between the Rest and the Clamp of the Jig.

Turning now to FIG. 6, the first preferred embodiment of the present invention is again shown in perspective view, viewed from the right front quarter, with Rest 24 and Roller 30 rotationally trapped within Sides 21 and 22 under Bar 23, and Clamp 40 movably attached to Rest 24. In addition, right and left Clamp nuts 74 and 75 have been worked by a user, and Held Tool 85 has thereby been secured between Clamp 40 and Rest 24.

Figure 7:
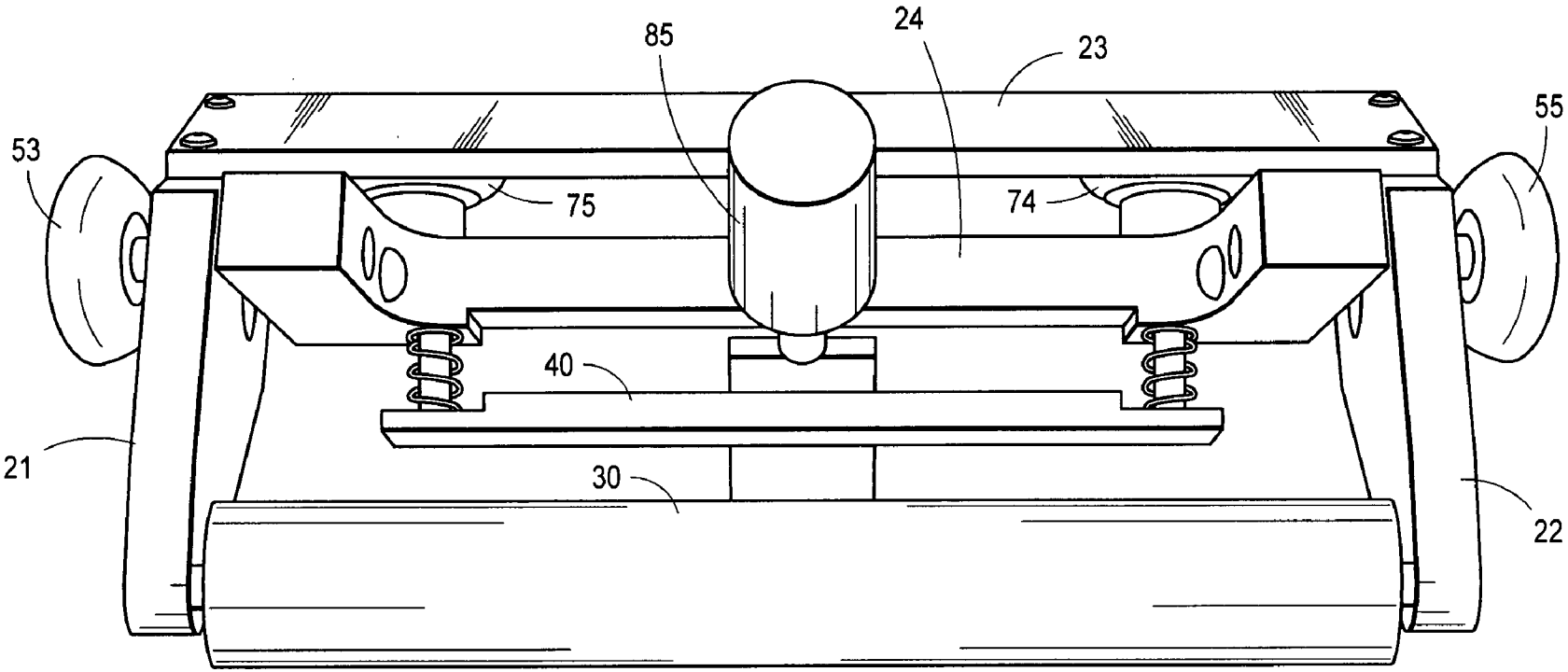
FIG. 7 is a perspective view drawing of the preferred embodiment of the Jig of the present invention shown in FIG. 2, viewed again from the rear of the Jig, in which a Held Tool (chisel) is secured between the Rest and the Clamp of the Jig.

In FIG. 7, the first preferred embodiment of the present invention is again shown in perspective view, viewed from the rear, with Rest 24 and Roller 30 rotationally trapped within Sides 21 and 22 under Bar 23, and Clamp 40 movably attached to Rest 24. In addition, right and left Clamp nuts 74 and 75 have been worked by a user, and Held Tool 85 has thereby been secured between Clamp 40 and Rest 24.

Figure 8:
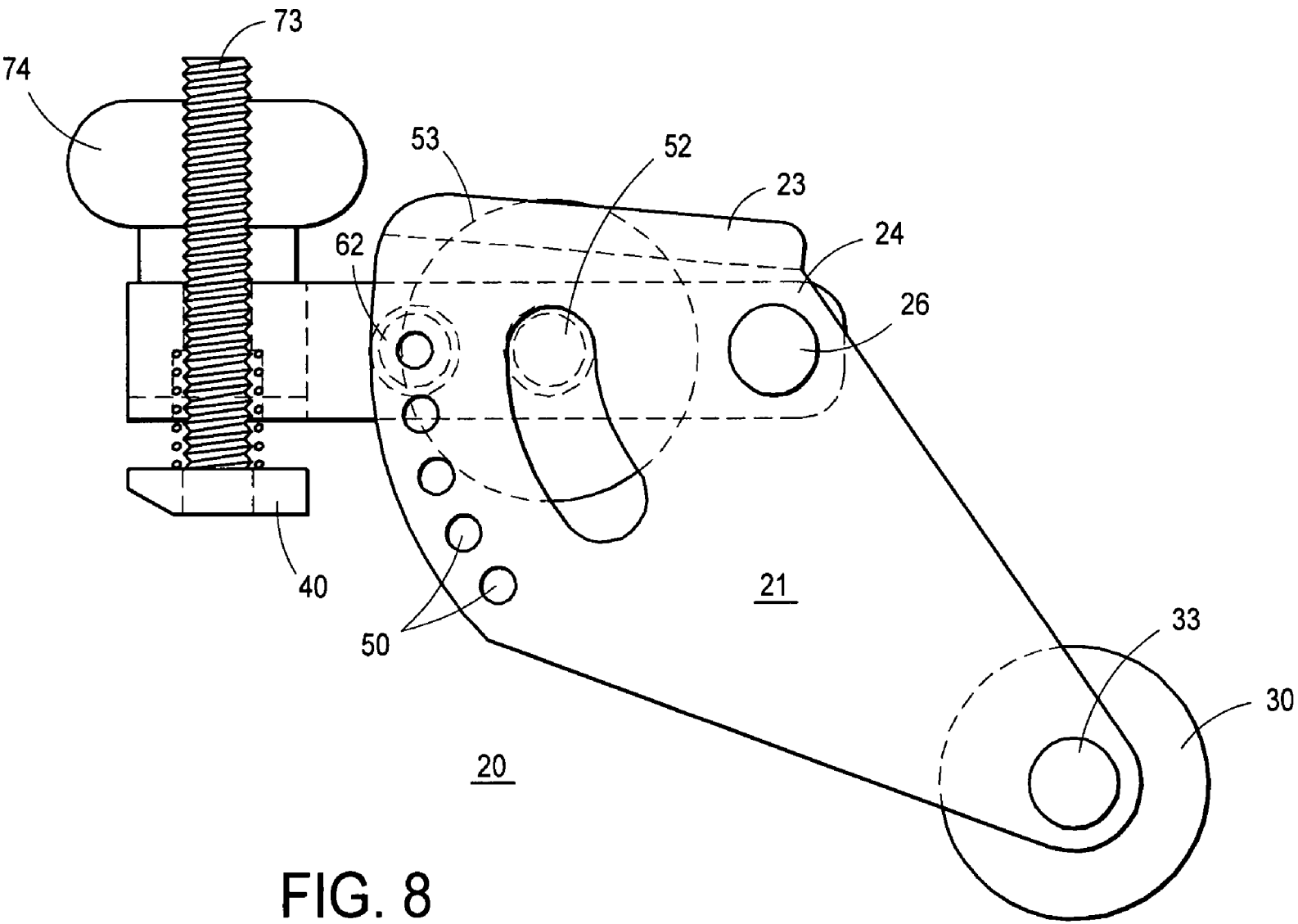
FIG. 8 is schematic view drawing of the preferred embodiment of the Jig of the present invention shown in FIG. 2, viewed from the left of the Jig.

FIG. 8 is schematic view drawing of the preferred embodiment of the Jig 20 of the present invention shown in FIG. 2, viewed from the left of Jig 20. In FIG. 8, Rest 24 and Roller 30 are again shown rotationally trapped within Sides 21 and 22 (Side 21 only showing in this end view) under Bar 23, and Clamp 40 is movably attached to Rest 24. In addition, left Roller Pin 33, left Rest Pin 26, left Tightening Pin 52, and left Tightening Pin nut 53 are all shown. In addition, five holes 50 are shown in left Side 21, along with left Plunger 62 set in Rest 24. In addition, the threads of left Clamp nut 74 is engaged with left Clamp bolt 73.

Figure 9:
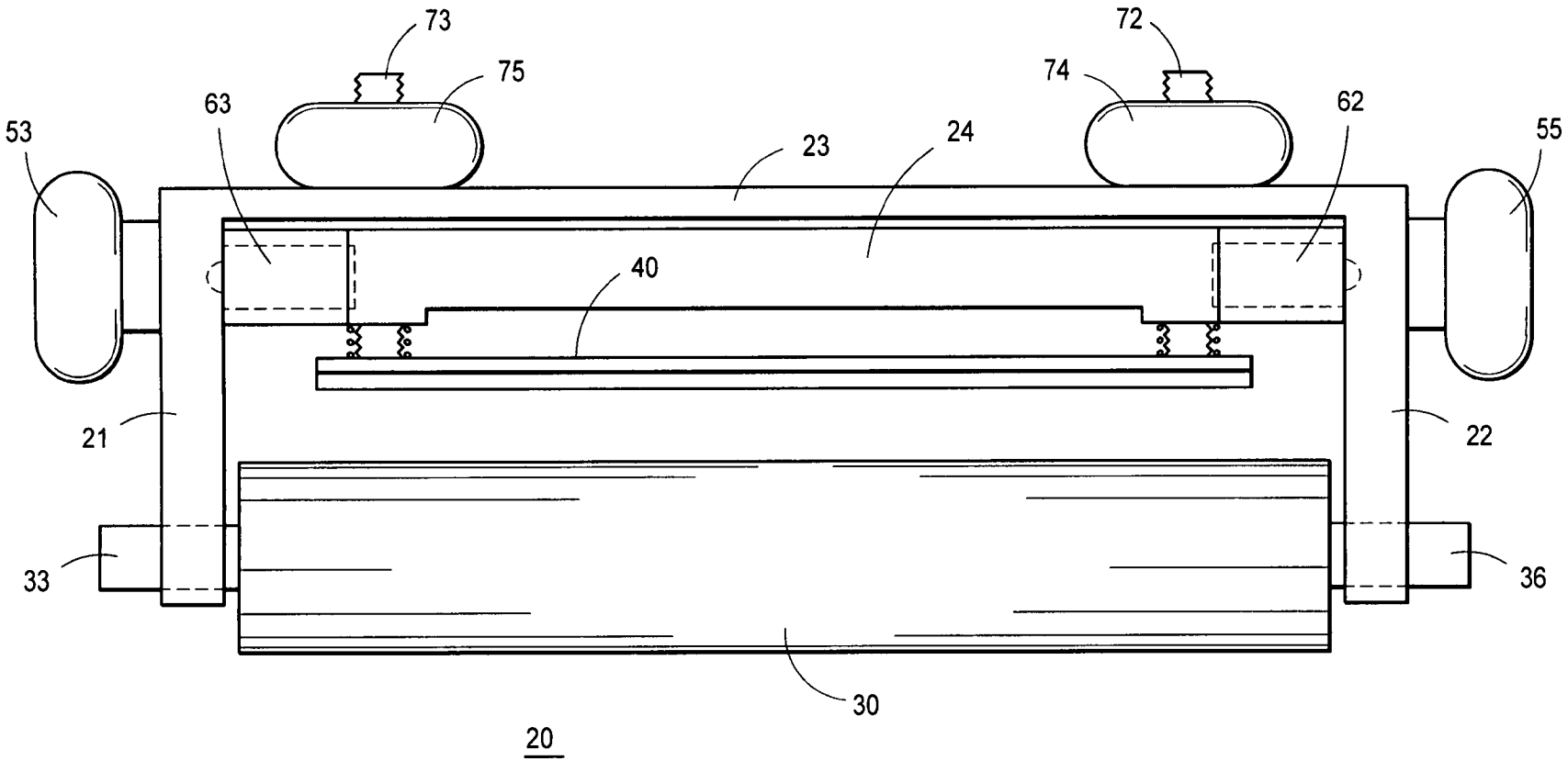
FIG. 9 is schematic view drawing of the preferred embodiment of the Jig of the present invention shown in FIG. 2, viewed from the rear of the Jig.

FIG. 9 is schematic view drawing of the preferred embodiment of the Jig of the present invention shown in FIG. 2, viewed from the rear of the Jig. In FIG. 9, Rest 24 and Roller 30 are again shown rotationally trapped within Sides 21 and 22 under Bar 23, and Clamp 40 is movably attached to Rest 24. In addition, left Roller Pin 33 and right Roller Pin 36 are shown, left Tightening Pin nut 53 and right Tightening Pin nut 55 are shown exterior to left Side 21 and right Side 22. In addition, left Plunger 63 and right Plunger 62 set in Rest 24 are shown. In addition, the threads of left Clamp nut 75 are engaged with left Clamp bolt 73, and the threads of right Clamp nut 74 are engaged with right Clamp bolt 72.

Second Preferred Embodiment

Figure 10:
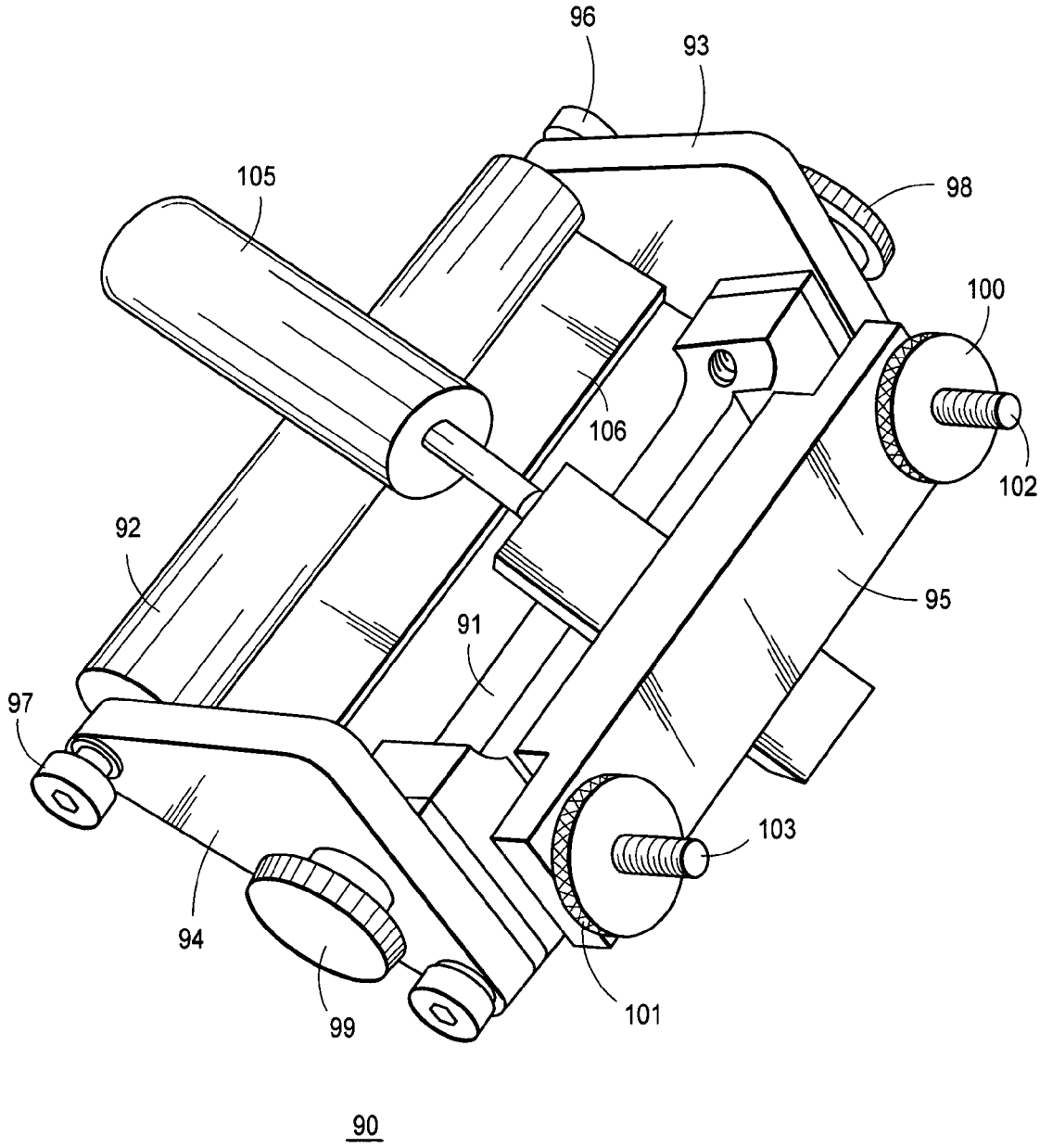
FIG. 10 is a perspective view of a second embodiment of the present invention, viewed from the right, and above elevation.

In some embodiments of the present invention, the Rest and Clamp may be reversed in their positions within the Jig, such that the Clamp is appended to the upper side of the Rest when the Jig is in sharpening position on a Disk. FIG. 10, for instance, is a perspective view of a second embodiment of the present invention, viewed from the right, and above elevation. FIG. 10 shows in Jig. 90 most of the components appearing in FIG. 2, including Rest 91 and Roller 92 rotationally trapped within Sides 93 and 94, and Clamp 95 movably attached to Rest 91. In addition, left Roller Pin 96 and right Roller Pin 97 are shown, left Tightening Pin nut 98 and right Tightening Pin nut 99 are shown exterior to left Side 93 and right Side 94. In addition, right and left threaded Clamp nuts 100 and 101 have been engaged with complementary threaded Clamp bolts 102 and 103 respectively. Clamp nuts 100 and 101 have been worked by a user onto Clamp bolts 102 and 103, with the result that Held Tool 105 has thereby been secured between Clamp 95 and Rest 91 within Jig 90.

However, in FIG. 10, Bar 106 is positioned on the underside of Jig 90, rather than on its upper side as in the first preferred embodiment shown in FIG. 2. In such position, Rest 91 is positioned within the Jig above Bar 106. In addition, while Clamp 95 is movably attached to Rest 91 as in FIG. 2, Clamp 95 is above Rest 91 when the Jig is in sharpening position. In such position, it may be appreciated that Clamp bolts 102 and 103 must not extend through Rest 91, so as to extend toward the sharpening Disk (not shown) when sharpening is underway. As with the situation in which the Clamp is below the Rest, any such extension of Clamp bolts 102 and 103 below Rest 91 when Rest 91 is lower than Clamp 95 is likely to put Clamp bolts 102 and 103 on the surface of the Disk during such sharpening. Accordingly, when Clamp 95 in FIG. 10 is appended to the upper side of Rest 91, Clamp bolts 102 and 103 end at, and are firmly affixed to, the ends of Rest 91. When actuated by a user, Clamp nuts 100 and 101, move away from or toward ends of Clamp 95, thereby allowing (or urging) Clamp 95 to move along Clamp bolts 102 and 103. As Clamp nuts 100 and 101 are tightened on Clamp bolts 102 and 103, Clamp 95 is urged toward Rest 91, and Held Tool 105 is thereby secured in Jig. 90 between Clamp 95 and Rest 91. FIG. 10 does not show holes in Sides 93 and 94, or matching left and right Plungers, similar to these components shown in FIG. 2, and so a user cannot rely on the "click" angle setting afforded by such components. However, such additional components may be added to Jig 90, and all such modifications or improvements are within the scope of the present invention.

Other embodiments will be apparent to those skilled in the art from consideration of the specification and practice of the invention disclosed herein. It is intended that the specification and examples be considered as exemplary only, with a true scope of the invention being indicated by the following claims and equivalents.

What is claimed is:

1. A tool sharpening jig comprising:

a jig body having a first side rigidly connected with a bar to a second side;

a roller, and means for rotationally attaching the roller between the first side of the jig and the second side of the jig;

a rest, and means for rotationally attaching the rest between the first side of the jig and the second side of the jig;

means for temporarily rotationally fixing the position of the rest between the first side of the jig and the second side of the jig;

a clamp, and means for movably attaching the clamp to the rest.

2. The tool sharpening jig of claim 1, in which the means for rotationally attaching the roller between the first side of the jig and the second side of the jig comprises a first roller pin and a second roller pin.

3. The tool sharpening jig of claim 1, in which the means for rotationally attaching the rest between the first side of the jig and the second side of the jig comprises a first rest pin and a second rest pin.

4. The tool sharpening jig of claim 1, in which the means for temporarily rotationally fixing the position of the rest between the first side and the second side of the jig comprises a plurality of threaded tightening pins, a plurality of threaded wells in the rest with threads formed to engage the threads of the plurality of tightening pins, and at least one slot in at least one of the first side and the second side of the jig through which the plurality of tightening pins may extend.

5. The tool sharpening jig of claim 4, in which the means for temporarily rotationally fixing the position of the rest between the first side and the second side of the jig further comprises a plurality of finger-actionable tightening nuts attached to the ends of the plurality of tightening pins.

6. The tool sharpening jig of claim 1, in which the means for temporarily rotationally fixing the position of the rest between the first side and the second side of the jig comprises a plurality of threaded tightening pins attached to at least one end of the rest, and at least one slot in at least one of the first side and the second side of the jig through which the plurality of tightening pins may extend.

7. The tool sharpening jig of claim 6, in which the means for temporarily rotationally fixing the position of the rest between the first side and the second side of the jig further comprises a plurality of finger-actionable tightening nuts with threads formed to engage the threads of the plurality of tightening pins.

8. The tool sharpening jig of claim 1, in which the means for movably attaching the clamp to the rest comprises:

a first clamp bolt having threads, and a second clamp bolt having threads;

a first clamp nut formed to engage the threads of the first clamp bolt, and a second clamp nut formed to engage the threads of the second clamp bolt; and a first spring positioned around the first clamp bolt between the clamp and the rest, and a second spring positioned around the second clamp bolt between the clamp and the rest.

9. The tool sharpening jig of claim 1, further comprising a plurality of plungers fitted in at least one end of the rest, the plurality of plungers having at least one movable end which tends to move toward at least one of the first side and the second side of the jig, and a plurality of holes in at least one of the first side and the second side of the jig, the plurality of holes positioned to allow the at least one movable end of the plurality of plungers to align with at least one of the plurality of holes as the rest is rotated within the jig.

* * * * *